United States Patent [19]

Lietzke

[11] Patent Number: 4,512,541

[45] Date of Patent: Apr. 23, 1985

[54] DISPLAY STAND

[75] Inventor: G. W. Lietzke, Wheaton, Ill.

[73] Assignee: Container Corporation of America, Chicago, Ill.

[21] Appl. No.: 358,220

[22] Filed: Mar. 15, 1982

[51] Int. Cl.[3] ..... A47B 97/04

[52] U.S. Cl. ..... 248/459; 248/174; 206/45.25

[58] Field of Search ..... 248/459, 174; 211/72, 211/73, 132; 206/45.21, 45.25, 45.29; 40/124.1, 539

[56] References Cited

U.S. PATENT DOCUMENTS

| | | | |
|---|---|---|---|
| 814,706 | 3/1906 | Isacke | 248/174 |
| 936,986 | 10/1909 | Conley | 229/31 R |
| 1,379,612 | 5/1921 | Baver | 248/459 |
| 1,495,864 | 5/1924 | Miller | 248/459 |
| 2,028,522 | 1/1936 | Rice | 206/45.29 |
| 2,360,014 | 10/1944 | Ressinger | 248/174 |
| 4,330,102 | 5/1982 | Gebhardt | 248/459 |

FOREIGN PATENT DOCUMENTS

| | | | |
|---|---|---|---|
| 695319 | 9/1965 | Italy | 40/539 |
| 155044 | 12/1920 | United Kingdom | 248/174 |

*Primary Examiner*—William H. Schultz
*Assistant Examiner*—Robert A. Olson
*Attorney, Agent, or Firm*—Richard W. Carpenter

[57] ABSTRACT

A one-piece paperboard display stand having a deck for holding an article of merchandise to be displayed, and an integral header member having a display panel. Interlocking engagement structure is provided to maintain the display panel of the header member in a vertical position against the deck.

3 Claims, 7 Drawing Figures

DISPLAY STAND

BACKGROUND OF THE INVENTION

1. Field of the Invention

This invention relates generally to display stands, and more particularly to a one-piece display stand which includes a base member having a platform and a header with a display panel for an advertising message.

2. Description of the Prior Art

A prior art search directed to the subject matter of this application in the U.S. Patent and Trademark Office disclosed the following U.S. Pat.: Nos. 1,614,265; 1,835,714; 2,479,910; 2,783,013; 2,797,815; 2,880,923; 2,953,292; 2,957,615.

None of the prior art patents uncovered in the search disclosed a unitary display stand having base and header members and means for providing interlocking engagement therebetween to maintain the display panel of the header member in a vertical position against the base member.

SUMMARY OF THE INVENTION

This invention relates generally to display stands, and more particularly to a stand having a platform or deck portion on which to display an article of merchandise and an integral header member having a display panel for carrying an advertising message behind the displayed article of merchandise.

It is an object of the invention to provide, in a display stand of the type described, a one-piece structure which affords a three-sided pedestal type display.

A more specific object of the invention is the provision of a novel means interconnecting base and header portions of the display to maintain the latter in a vertical position.

Another object of the invention is the provision of a novel bellows arrangement interconnecting portions of the display stand to prevent the raw edges of certain walls of the stand from being seen.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 4:
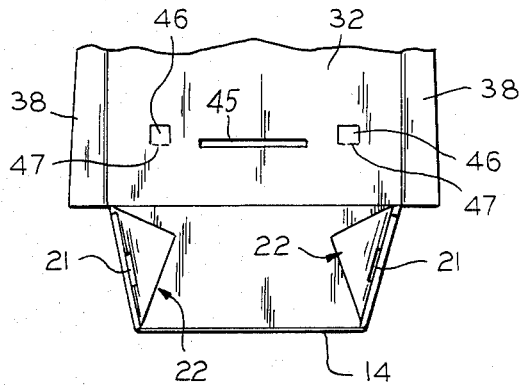
FIGS. 2 through 6, are perspective views illustrating the manner in which the display stand illustrated in FIG. 1 is assembled.
Figure 5:
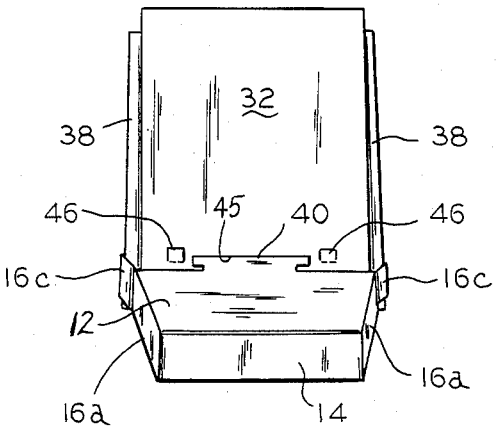
Figure 6:
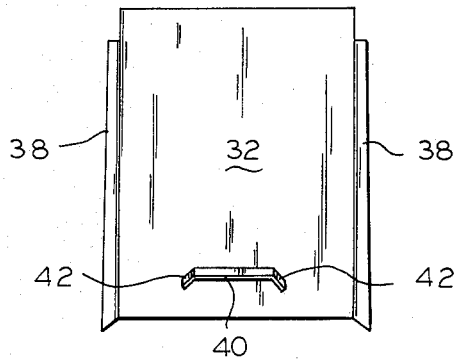
Figure 1:
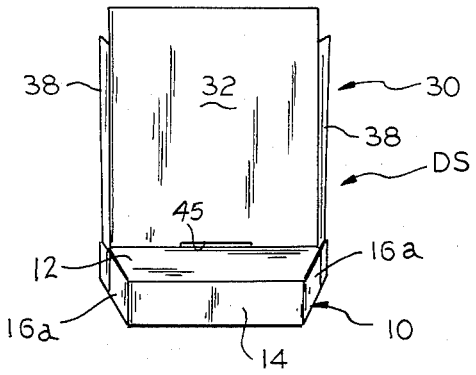
FIG. 1 is a perspective view of a collapsible one-piece display stand embodying features of the invention.
Figure 7:
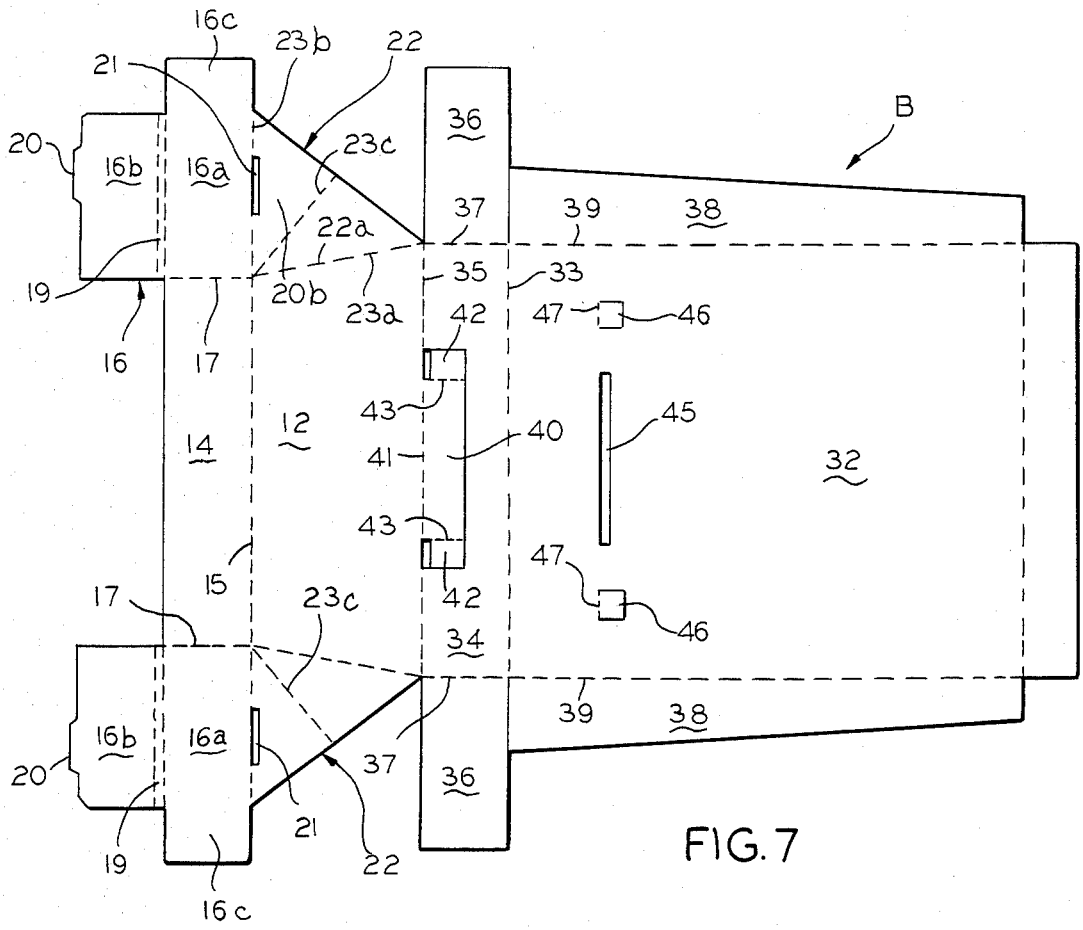
FIG. 7 is a plan view of a blank of foldable sheet material from which the display stand illustrated in the other views may be formed.
Figure 2:
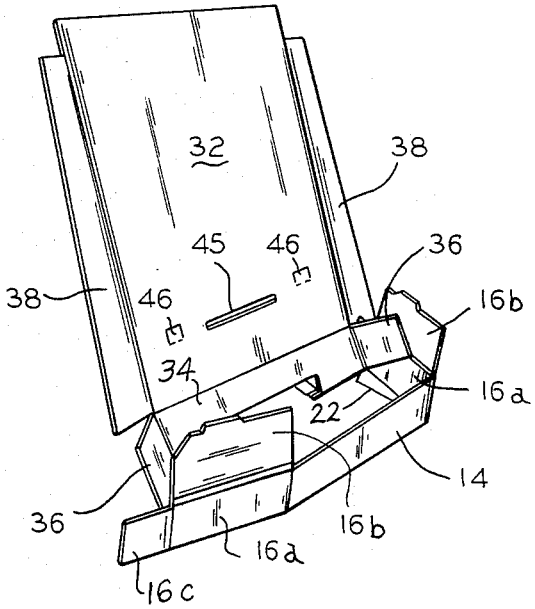
Figure 3:
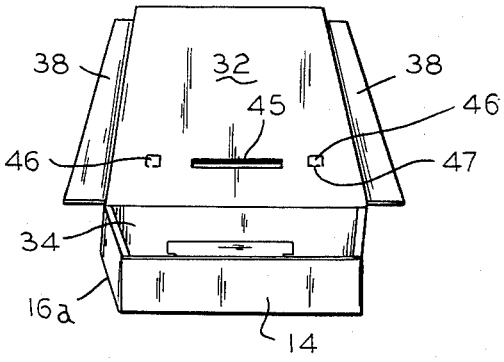

Referring now to the drawings for a better understanding of the invention, it will be seen that the unitary display stand, indicated generally at DS in FIG. 1, may be formed from the unitary blank B of foldable sheet material, such as paperboard, illustrated in FIG. 7.

As best seen in FIG. 1 the display stand includes a base or platform member, indicated generally at 10, and a generally vertically extending header member, indicated generally at 30, which is formed integrally with the base member and projects upwardly from a rear portion of the base member.

Base member 10 is a box-like structure which includes a generally horizontally disposed top wall or deck 12, and opposed front and rear side walls 14 and 34 and opposed end walls 16 which are foldably joined to each other and to the corresponding edges of top wall 12 and which depend therefrom to form therewith a box-like structure. Front and rear side walls 14 and 34 are foldably joined to front and rear side edges of panel 12 along fold lines 15 and 35, respectively.

Each of the end walls 16 includes a pair of outer and inner panels **16*a* and 16*b*, respectively, which are foldably joined to each other on fold lines 19, with each of the outer end wall panels 16*a* being foldably joined to the adjacent end edge of front side wall panel 14 along a fold line 17. Each of the end wall outer panels 16*a* is provided with a rearwardly projecting extension 16*c***, the purpose of which is described later in the specification.

In order to make the display stand more attractive by hiding from view the raw edges of the top and end walls of the base member, the end walls 16 may be joined to the top wall 12 by means of bellows or gusset members indicated generally at 22. As best seen in FIG. 7, each of the gusset members 22 includes a pair of first and second, generally triangular gusset sections **22*a* and 22*b*, which are foldably joined along fold lines 23*a* and 23*b* to adjacent panels 12 and 16*a*, respectively, and which are foldably joined to each other along a diagonal fold line 23*c***.

When the base member of the display stand is erected, the gusset members are folded in face-to-face relation with each other under the top wall panel 12, so that the box-like structure is formed.

In assembling the structure, the corner flaps 36, which are foldably joined on fold lines 37 to opposite end edges of rear wall panel 34, are interposed between the inner and outer panels **16*a* and 16*b* of the end walls and locked in position by the insertion of a Walker lock-type tab 20 of each inner panel 16*a* into a slot 21 presented in an adjacent gusset section 22*b* located adjacent the fold line 23*b***.

Turning now to the other portion of the structure which represents the header member indicated generally at 30, it will be seen that the greater portion of the header member comprises a display panel, indicated generally at 32, which is foldably joined at its lower edge on fold line 33 to the lower edge of base member rear side wall 34.

Panel 32 is folded upwardly at 180° so that its lower portion lies in face-to-face relation with the rear surface of base member rear side wall panel 34.

Display panel 32 is provided at sides thereof with a a pair of relatively narrow flanges 38 which are foldably joined on fold lines 39 to opposite side edges of panel 32. The purpose of these flanges is to help maintain the display panel in a vertical position, as they are folded rearwardly from the display panel and serve as a reinforcing and support means for panel 32. They also serve to cover the edges of the display panel 32, so that again no raw edges of the structure are visible.

The extensions **16*c*, which were previously mentioned in connection with base member end walls 16, project rearwardly from the base member and engage portions of the outer surfaces of flanges 38 and help prevent the flanges 38 from straightening out, so the flanges remain in an angular position relative to panel 32**.

Also, in order to further maintain panel 32 in a vertical position at right angles to base member top wall 12 there is provided a means for interlocking engagement between the base and header members.

This interlocking engagement includes a lock flap 40, which is cut from material of base member rear side wall 34, and which is foldably joined to the rear edge of base member top wall panel 12 along a fold line 41. Lock flap 40 has a a pair of tabs 42, which are also cut from the material of rear wall panel 34, and which are foldably joined on fold lines 43 to opposite end edges of tab 40. Flap 40 and tabs 42 are folded and inserted through a related slot 45 in display panel 32 to lock the panel to the platform member.

If desired, panel 32 may also be provided with a pair of retaining tabs 46 which are cut from material of the panel and foldably joined thereto on fold lines 47. The purpose of these tabs is to hold in place a separate card or advertising display panel in front of the display panel 32 where so desired.

Thus, it will be seen the invention provides a novel display stand of relatively simple design and construction which presents a unique and attractive arrangement for displaying article of merchandise.

What is claimed is:

1. A display stand including integral base and header members formed from a unitary blank of foldable sheet material such as paperboard, comprising:

(a) a header member including a vertically disposed display panel having a pair of support flanges foldably joined to opposite side edges thereof and disposed to extend rearwardly from said panel for support thereof;

(b) said panel presenting, adjacent a lower end thereof a retaining slot extending therethrough;

(c) a base member including a rear wall, a top wall, and a front wall foldably joined to form a box-like structure;

(d) said base member rear wall being foldably joined at a lower edge to a lower edge of said display panel and folded to lie in face-to-face engagement with a front surface of said display panel;

(e) said base member rear wall including a retaining flap cut from material thereof, folded thereto at an upper edge thereof, and disposed to extend through said display panel retaining slot to provide interlocking engagement therebetween;

(f) said base member rear wall having foldably joined to opposite ends thereof a pair of intermediate end flaps;

(g) said base member front wall having foldably joined to opposite ends thereof a pair of outer end flaps;

(h) each of said outer end flaps having foldably joined to a lower edge thereof an inner end flap;

(i) each of said base member intermediate end flaps being sandwiched between a related pair of inner and outer end flaps.

2. A display stand according to claim 1, wherein said base member top wall is foldably joined, at its end edges, to respective outer end flaps by bellows members, so that no raw edges of said top or outer end flaps are exposed.

3. A display stand according to claim 2, wherein said base member inner end flaps have interlocking engagement with respective bellows members.

* * * * *